US005414988A

United States Patent [19]

DiPalma et al.

[11] Patent Number: 5,414,988

[45] Date of Patent: May 16, 1995

[54] DEVICE FOR TWISTING ROPE-SHAPED MATERIAL WITH CHANGING TWIST DIRECTION

[75] Inventors: Michele DiPalma, Springe; Harry Staschewski; Ernst Hoffmann, both of Langenhagen, all of Germany

[73] Assignee: Kabelmetal Electro GmbH, Hanover, Germany

[21] Appl. No.: 281,133

[22] Filed: Jul. 27, 1994

Related U.S. Application Data

[63] Continuation of Ser. No. 970,152, Nov. 2, 1992, abandoned.

[30] Foreign Application Priority Data

Nov. 4, 1991 [DE] Germany ..... 41 36 266.7

[51] Int. Cl.[6] ..... D01H 7/46; B65H 20/00

[52] U.S. Cl. ..... 57/293; 226/172

[58] Field of Search ..... 57/293, 294, 138; 226/172

[56] References Cited

U.S. PATENT DOCUMENTS

| | | | |
|---|---|---|---|
| 1,865,362 | 6/1932 | Evans | 57/138 |
| 3,225,798 | 12/1965 | Dessureau | 57/59 |
| 3,526,570 | 9/1970 | Durkee et al. | 428/544 |
| 3,855,777 | 12/1974 | Durkee et al. | 57/293 X |
| 3,945,547 | 3/1976 | Ledebur | 226/172 |
| 4,000,636 | 1/1977 | Shubin et al. | 226/172 X |
| 4,311,002 | 1/1982 | Hoffmann et al. | 57/293 |
| 4,342,190 | 8/1982 | Ziemek et al. | 57/294 X |

FOREIGN PATENT DOCUMENTS 0431244 6/1991 European Pat. Off. .

OTHER PUBLICATIONS

"New Development in SZ Stranding", D. Vogelsberg, Frisch publication reprinted from *Wire and Cable Panorama,* Aug./Sep. 1985, DKS Fachverlag GmbH, Dusseldorf.

*Primary Examiner*—Daniel P. Stodola
*Assistant Examiner*—Michael R. Mansen
*Attorney, Agent, or Firm*—Ware, Fressola, Van Der Sluys & Adolphson

[57] ABSTRACT

A device (1) is used for twisting rope-shaped material (15), particularly of a larger cross section, with changing twist direction (SZ), consisting of a rotor (4) that changes direction and/or RPM, with two opposing chain drives (7) for the material (15), which are parallel to the rotor axis along an endless path. The material is gripped, guided and subsequently released by collet chucks along a prescribed pathway determined by a pressure rail (16). The collet chucks (14) are additionally attached to the chain drives (7) outside of the pathway, and are force-guided along the endless path.

11 Claims, 7 Drawing Sheets

DEVICE FOR TWISTING ROPE-SHAPED MATERIAL WITH CHANGING TWIST DIRECTION

This is a continuation of application Ser. No. 07/970,152, filed on Nov. 2, 1992, now abandoned.

TECHNICAL FIELD

The present invention relates to a device for twisting rope-shaped material with changing twist direction.

BACKGROUND OF THE INVENTION

This invention concerns a device for twisting rope-shaped material, particularly of large cross section, with changing twist direction (SZ), consisting of a rotor that changes direction and/or RPM, with two opposing chain drives that are parallel to the rotor axis along an endless path, for collet chucks that grip the material and guide it along a prescribed path determined by a pressure rail, and which subsequently release the material.

Devices of this type have been known for a long time as shown, for example, in U.S. Pat. No. 4,311,002. See also "New developments in SZ-stranding" by Dipl.-Ing. Dieter Vogelsberg in *Wire and Cable Panorama,* Aug./Sept. 1985, DKS Fachverlag GmbH, Dusseldorf. Such devices provide the possibility of twisting large cross section leads, such as are required to transmit and distribute electric power, into a cable core according to the SZ-twisting process, used until the priority date of U.S. Pat. No. 4,311,002 only for communication cable leads. At the end of the above-cited article is described a manufacturing program, for example, SZ-stranding machines for optical fiber conductors (small cross-section) or SZ-stranding machines for sheathed power cable on IKV cable (larger cross-section). The individual leads are gathered into a bundle, then held by collets of the device, and, while held along a determined path, they are twisted by rotation of the rotor, by changing the twist direction and/or the RPM. The release of the twisted leads at the end of the defined path (storage path) is caused by return springs located in each collet chuck half. Since the reliability of the collet release, and therefore the reliability of releasing the twisted material, depends on the reliability of the springs, there is occasionally the danger of a collet chuck seizure disturbing the synchronized operation along the prescribed chain path. This danger exists especially during high production speeds, due to the corresponding centrifugal forces taking place at that time.

DISCLOSURE OF INVENTION

Starting from this state of the art, the invention has the task of ensuring the reliability of the collet release in connection with the pathway under the pressure rail, independently of the production speed, and to assure the synchronized operation of the collets along the prescribed movement path.

This task is fulfilled by the invention, where the collet chucks outside of the pathway are additionally force-guided along the endless path for attachment to the chain drives. This forced guidance applies equally to all collets, so that any irregularities in the reliability of the return springs of each individual collet chuck are eliminated from the start. The forced guidance ensures the synchronized operation of the pair of collet chucks, and the synchronization is not adversely affected by higher revolution speeds of the rotor.

The forced guidance itself can be achieved in any desired manner. However, it has been proven to be of special advantage to the invention if the forced guidance consists of a profile rail, in which a supporting roller is located. Excursion of this supporting roller along the forced guidance is impossible, the supporting roller is only released in the pathway determined by the pressure rail, i.e. during the clamping or when the collet chucks become effective.

If, as is usual, the collet chucks consist of an outside carriage part and a sled part that is movable with respect to the latter, the supporting rollers lock onto the respective sled part. This means for the device of the invention that, when the supporting roller enters into the forced guidance at the end of the pressure rail, thereby unloading the pressure roller and lifting the sled part, finally the entire collet is returned to the starting point via the prescribed chain pathway.

At this (starting) point, the supporting roller leaves the forced guidance, the pressure rail and pressure roller become effective, so that the sled part of each collet chuck, including the corresponding supporting roller, move the pressure roller, which is pressure-loaded by the pressure rail, in the direction of the material, and the transport along the prescribed pathway can take place after the material has been gripped. This process requires that the pressure rail becomes effective after the supporting roller is released from the profile rail, and before it is reinserted.

It is important for the material being twisted, that the collet chucks grip uniformly, and do not tilt during the guidance, to prevent damage to the material. For that reason, it was a practice until now to guide each individual collet chuck, so that the carriage part surrounding the sled part slides along a running rail by means of a roller arrangement. However, faster rotor revolution and the corresponding centrifugal forces have shown that, until now, the guidance of the carriage part was insufficient, because the collet chucks always tilted or tipped. To remedy this situation and guide the carriage part surrounding the sled part, the invention provides a running rail that extends on both sides along the length of the pressure rail in the axial direction. It is useful to dimension the extension so that the carriage part is guided by the running rollers along its length, until the pressure roller becomes effective. Right from the start, this eliminates any tilting or tipping of the collet chucks in the transition area between forced guidance and effectiveness of the collets, which is especially sensitive to disturbances. In this connection, it was shown to be advantageous to install four running rollers, symmetrically placed on the running rail, to guide the collet.

According to a further thought of the invention, the synchronous operation of the collet chucks along the prescribed pathways also requires attaching the collets to at least two chain links on the chain drives. A particularly advantageous solution results, when three chain drive links are used as holds, for symmetry purposes. Additional outside shackles are useful for attaching the collets, and at the same time serve to laterally stabilize the collets, as these hang on the chain drives.

The contact pressure of the collet chucks results from a pressure roller in each collet half, which is pressure loaded by the pressure rail and affects the sled part of the collet chuck. Depending on the diameter of the material to be twisted, and the sensitivity of its surface to pressure load, etc., adapting the respective contact pressure of the collet chucks to the material is often unavoidable. In this connection, it was proven useful for the invention to produce the contact pressure of the pressure rollers by centrally adjusting the position of the pressure rail.

Devices of this type always have two collet halves joining from opposing sides of the material, at the point of effectiveness on the material. This not only is important to the synchronous operation of a chain drive, but rather the synchronous operation of both chain drives must be considered, if the material is to be gripped without damage by collet chucks on two sides. To achieve this, the drive motors are connected to each other by conical gears. The same purpose is achieved with spur-toothed gears or chain drives, instead of the conical gears.

For twisting the leads of an electric power cable without problems, for example with equal length of lay and uniform twist, it is important for the material to be stretched when it runs over the prescribed path under the pressure rail. It was shown to be advantageous for this purpose to use three simultaneously loaded collet pairs along the length of the forced guidance and the pressure rail.

These and other objects, features and advantages of the present invention will become more apparent in light of the following detailed description of a best mode embodiment thereof, as illustrated in the accompanying drawing.

BRIEF DESCRIPTION OF THE DRAWING

FIG. 1 shows how FIGS. 1A and 1B fit together.

BEST MODE FOR CARRYING OUT THE INVENTION

Figure 1A:
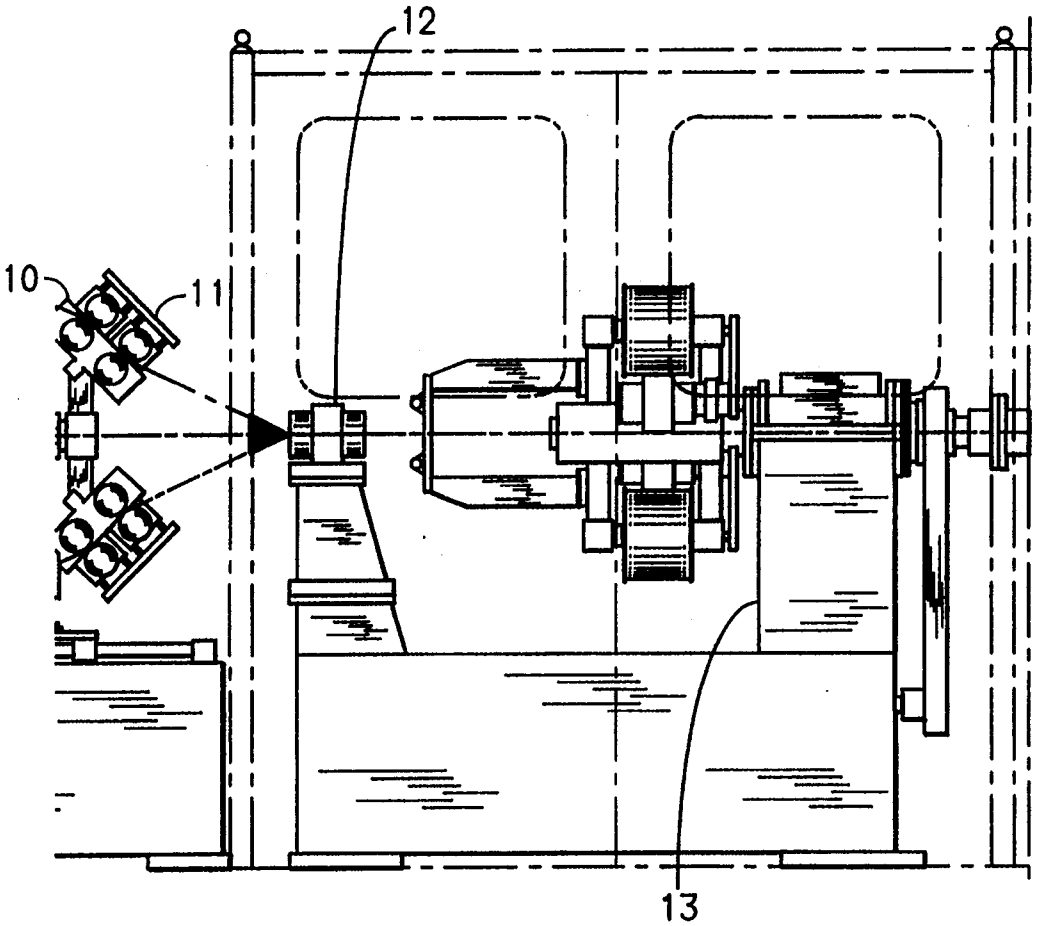
FIGS. 1A and 1B together show a typical twisting device 1 as a component of a full installation.
Figure 1B:
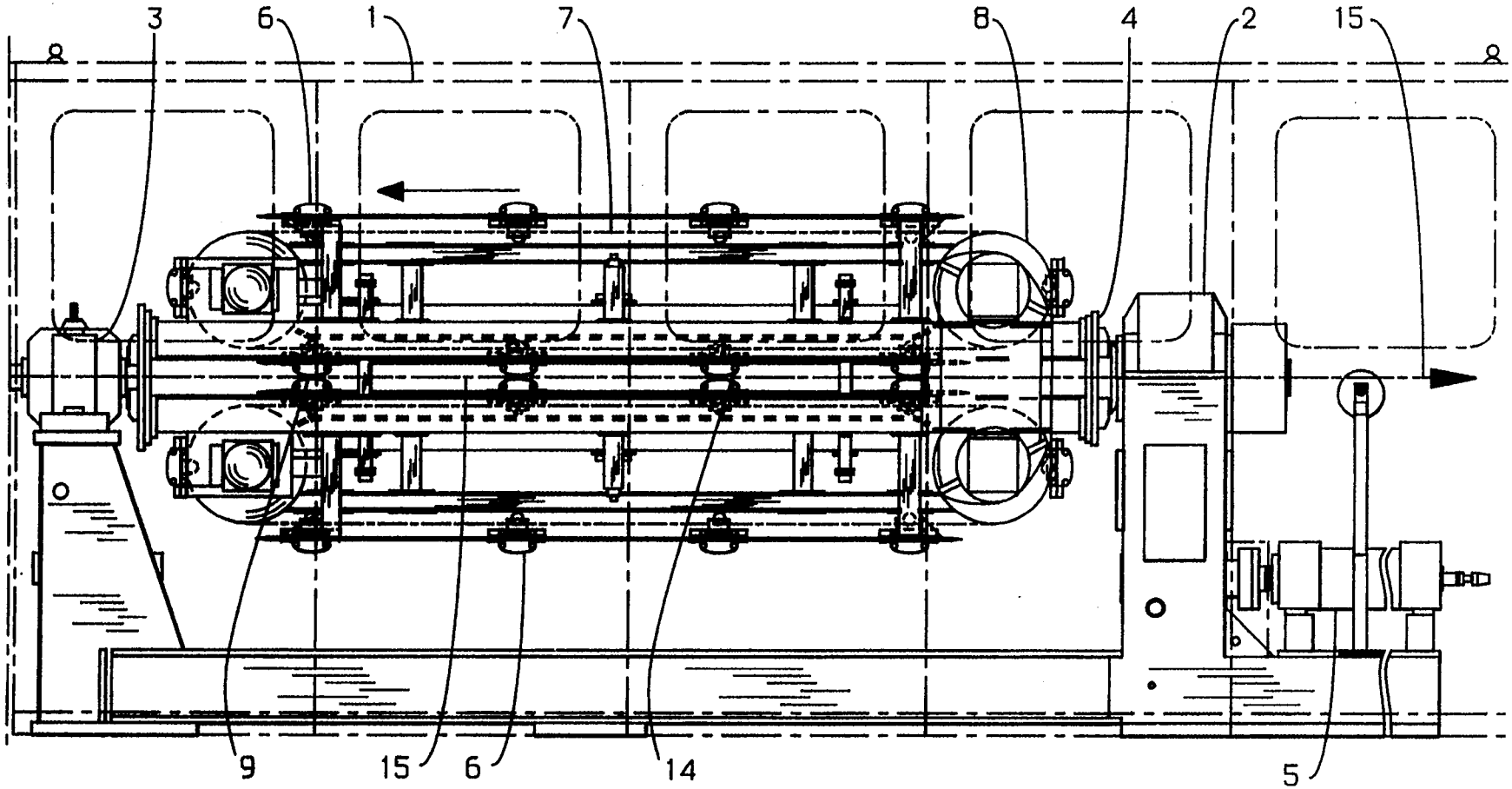

FIGS. 1A and 1B together show a typical twisting device 1 as a component of a full installation. It consists essentially of a rotor 4, which rotates inside of bearing blocks 2 and 3. This rotor 4 is driven by a motor 5, which changes direction; a drive with different revolutions can also be used to achieve the twisting effect. The collet chuck halves gripping the material are indicated by 6, and they are driven by chains 7, to which they are attached. The drive wheels 8, driven by drive motors in the rotor, guide the chains 7 in a closed path, while the collet chuck halves 6, as shown in a spot indicated by a reference numeral 9, move in the direction of the arrow and form a collet 14 that surrounds the material. The movement of the collet chuck halves 6 in the direction of the arrow is simultaneous with the rotation of the rotor 4 in the circumferential direction.

The material to be twisted, for example the leads 10 of an electric power cable, are drawn from not illustrated storage places and guided to the twisting point 12 via so-called roller guidance devices 11. The adjacent tape winding machine 13 is used to tape the twisted bundle before it enters the rotating twisting device 1. The twisted material 15 is stretched in this area and may then be wound on not illustrated storage spools.

Figure 2:
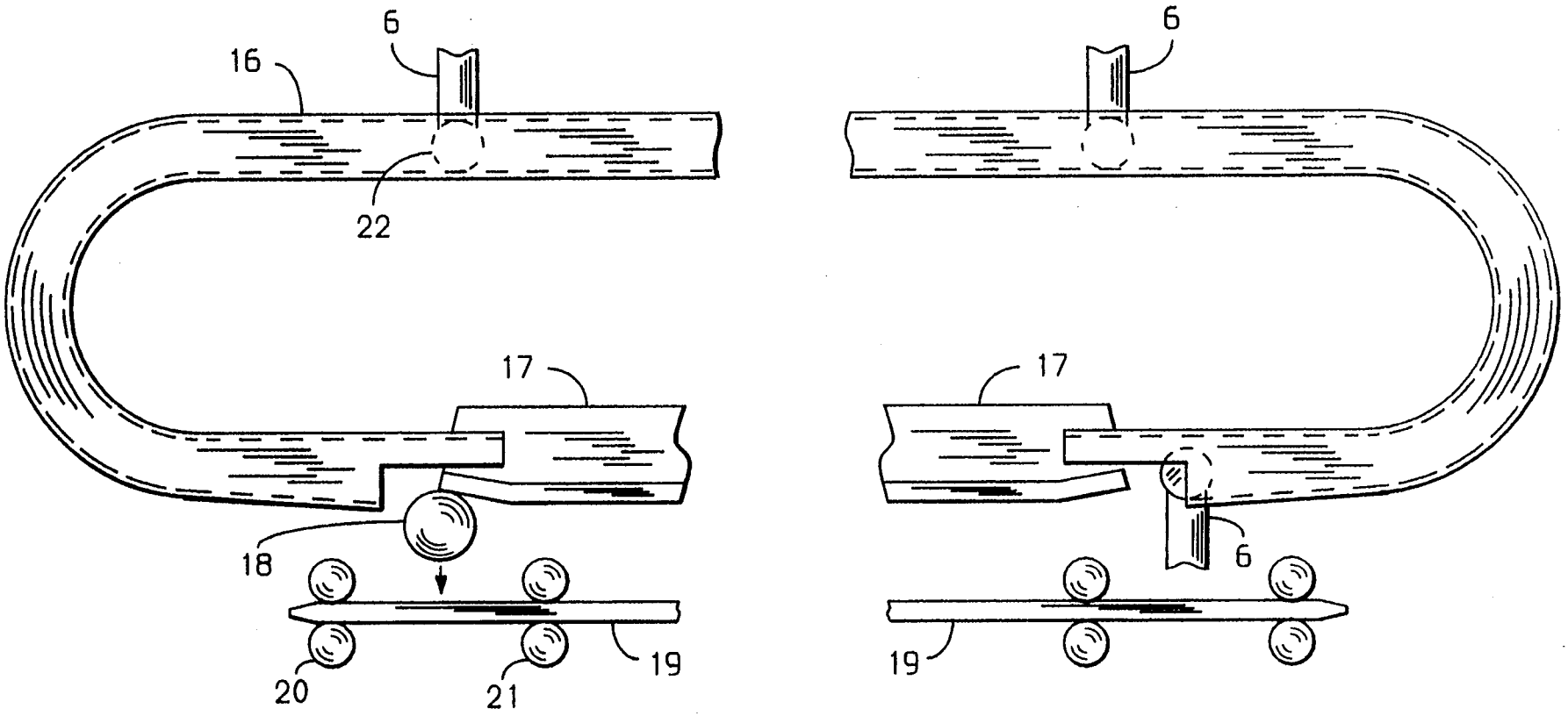
FIG. 2 shows a forced guidance, according to the present invention.

To ensure the synchronous operation of the collet chuck halves 6, independently of the RPM of rotor 4, and to provide that these collet chucks separate without any problem after they are closed, in addition to their attachment to both chains 7, the collet chucks also pass through a forced guidance. This measure is made clear in FIG. 2. It shows a forced guidance for the collet chuck halves 6 in the form of a profile rail 16, for example a U-shape that is adapted to the chain drive shape. This profile rail 16 ends at the pressure rail 17, which moves the pressure roller 18 assigned to each collet chuck half 6 in the direction of the arrow. Correspondingly, the pressure roller 18, which is guided along the pressure rail 17, is unloaded by the end of the pressure rail 17 because of its shape, and the profile rail 16 again picks up the collet chuck half 6. The running rail 19 is located below the pressure rail 17. It takes over the guidance of the opposing guidance rollers 20 and 21 arranged in pairs, which are located at the outer carriage part of each collet chuck half 6. The running rail 19 extends beyond the length of pressure rail 17, so that the incoming and outgoing movement of each collet chuck half 6 takes place uniformly and without tilting. The extension of this running rail 19 is selected so that, at the start of the pressure when the pressure roller 18 reaches the pressure rail 17, as shown, each collet chuck half 6 is already securely supported by both pairs of rollers 20 and 21 on the running rail 19. This provides a uniform transition from the forced guidance to the pressure-loaded guidance, and vice versa, from the pressure-loaded guidance to the forced guidance.

Figure 3:
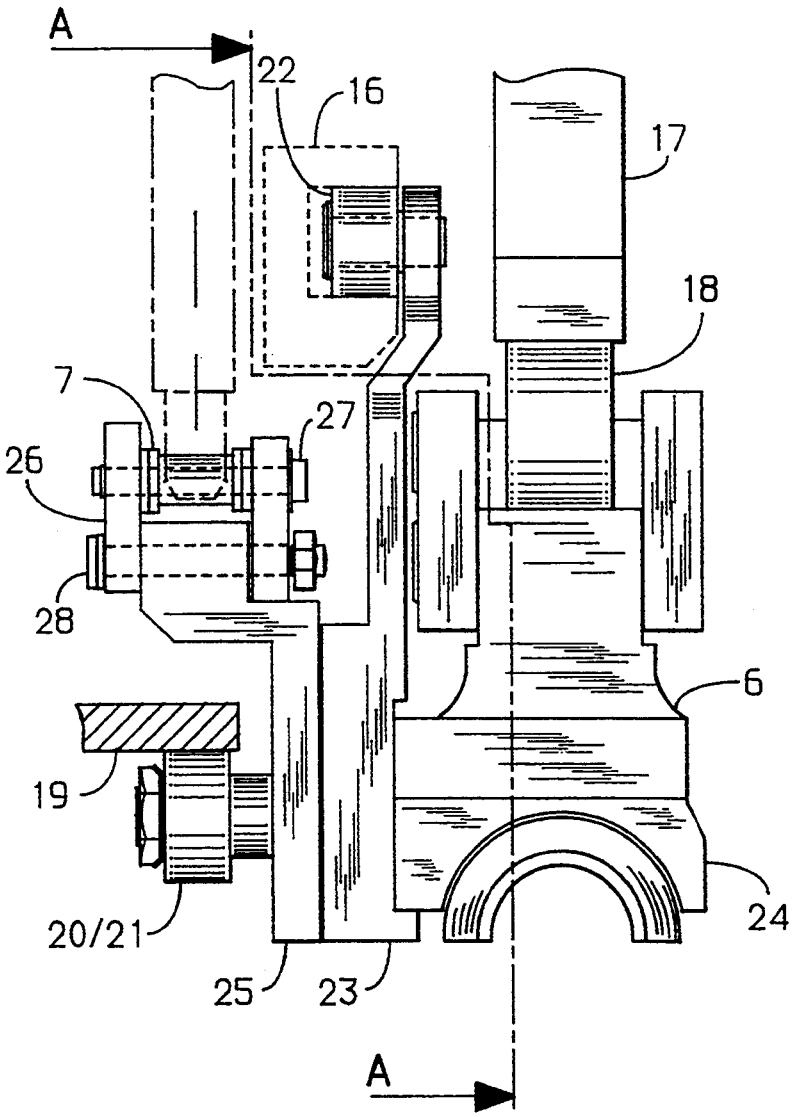
FIG. 3 shows a U-shaped profile rail, according to the present invention.
Figure 5:
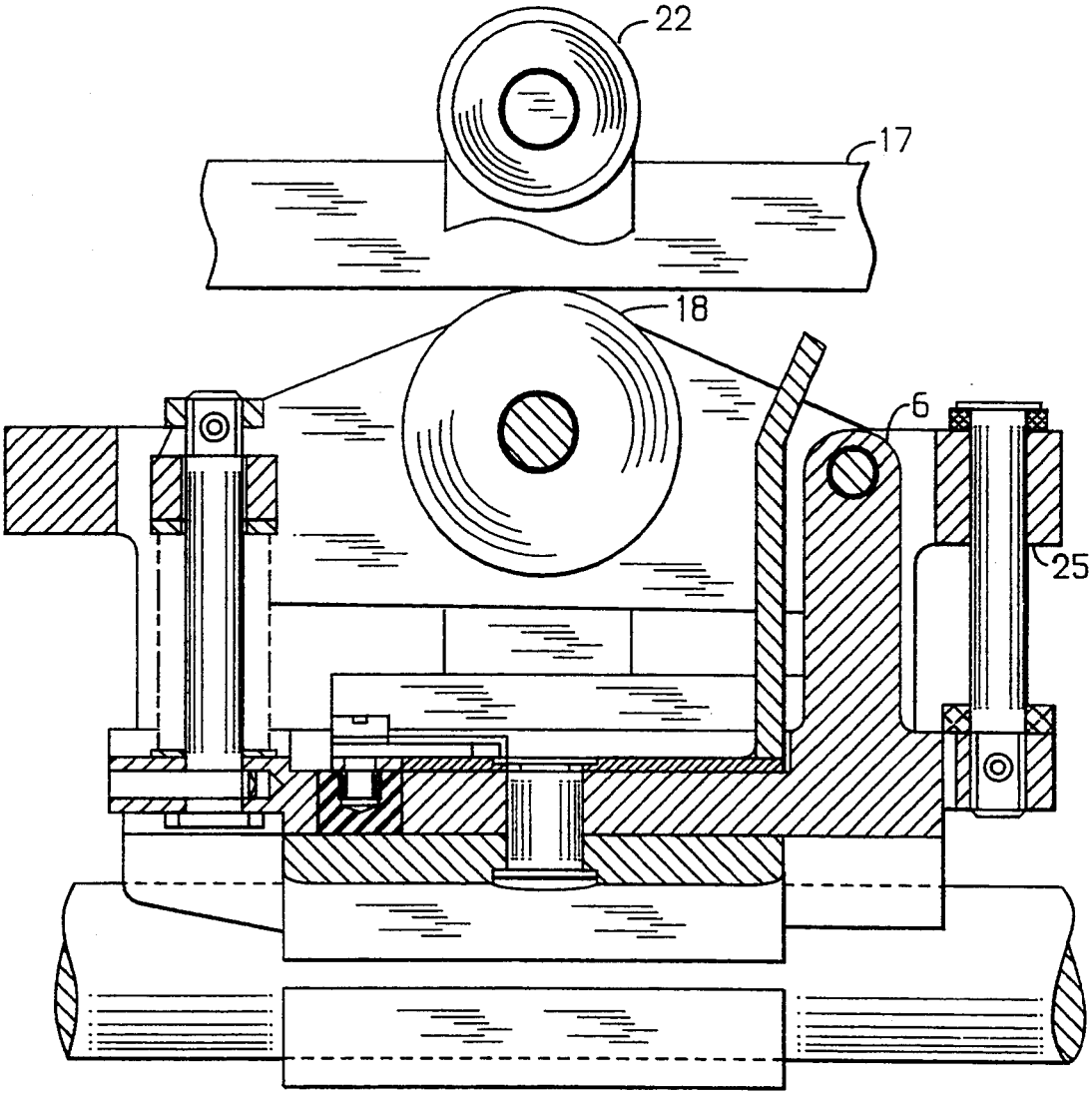
FIG. 5 shows a view of the U-shaped profile rail of FIG. 3 along a line A—A shown in FIG. 3.

As mentioned before, the forced guidance is exerted by a U-shaped profile rail. This configuration is shown in FIG. 3. FIG. 5 shows another view corresponding to the dotted line A—A of FIG. 3. The supporting roller 22 fits into the profile rail 16; it extends to the carrier 23, which is locked to the sled part 24. In the configuration example, the profile rail 16 is shown by broken lines, i.e. this profile rail is not active at the moment because the pressure roller 18 is being affected by the pressure rail 17, which means that the sled part 24 is pressed against the rope-shaped material. In a mirror image, a second collet chuck half holds the material from the other side, exerting a power grip between the material and the twisting device.

FIG. 3 also clarifies the connection between the outer carriage part 25 and the chain drive 7, where an outside shackle 26 is used, which is advantageously attached to three chain links by the protruding bolts 27, creating a vibration-resistant and tilt-free link. The bolt connection 28 serves to attach the outside shackle 26 to the outer carriage part 25.

Furthermore, to ensure a synchronous tilt-free operation, four running rollers 20 or 21 are provided on the outer carriage 25, and roll on the running rail 19 when the pairs of collet chuck halves 6 join up.

Figure 4:
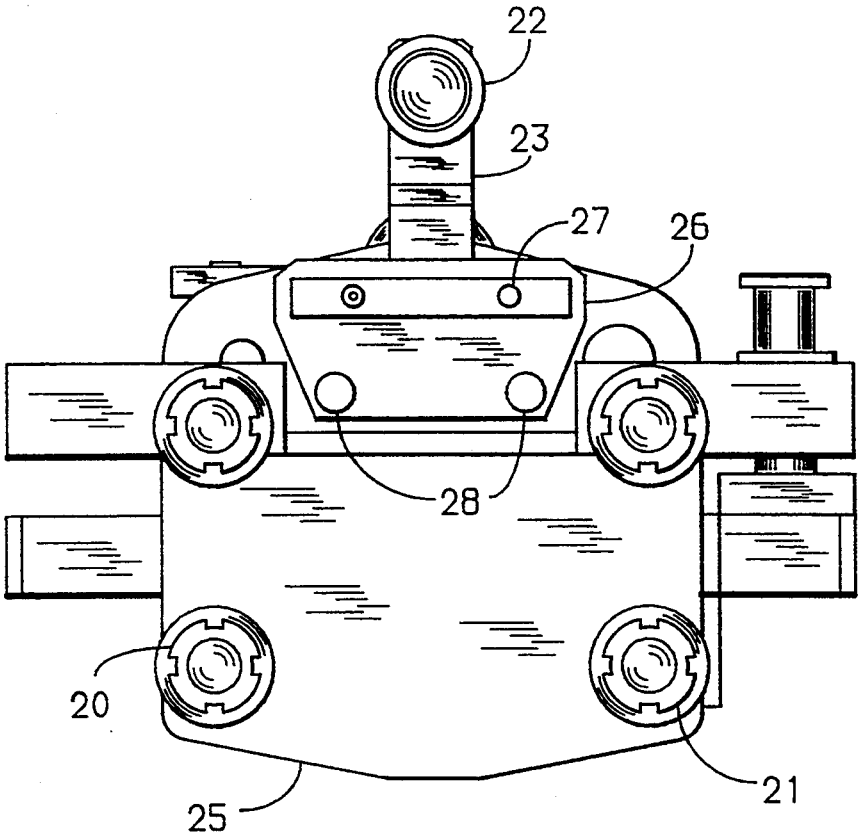
FIG. 4 shows a side view of the collet chuck, according to the invention.

A side view of the collet chuck according to the invention is shown in FIG. 4. The pairs of running rollers 20 and 21 are attached to the outer carriage part 25, symmetrically to each other and on both sides of the not illustrated running rail. The tilt-free connection between the outer carriage part and the chain drive is provided by the outside shackles 26 on both sides of the chain, which are linked to the chain by the traversing chain bolts 27, and are locked to the outer carriage part by bolt connection 28. The holder 23, which is locked to the sled part, carries the supporting roller 22 on its upper end. This supporting rollers fits into the profile rail, which serves as the forced guidance during operation.

Figure 6:
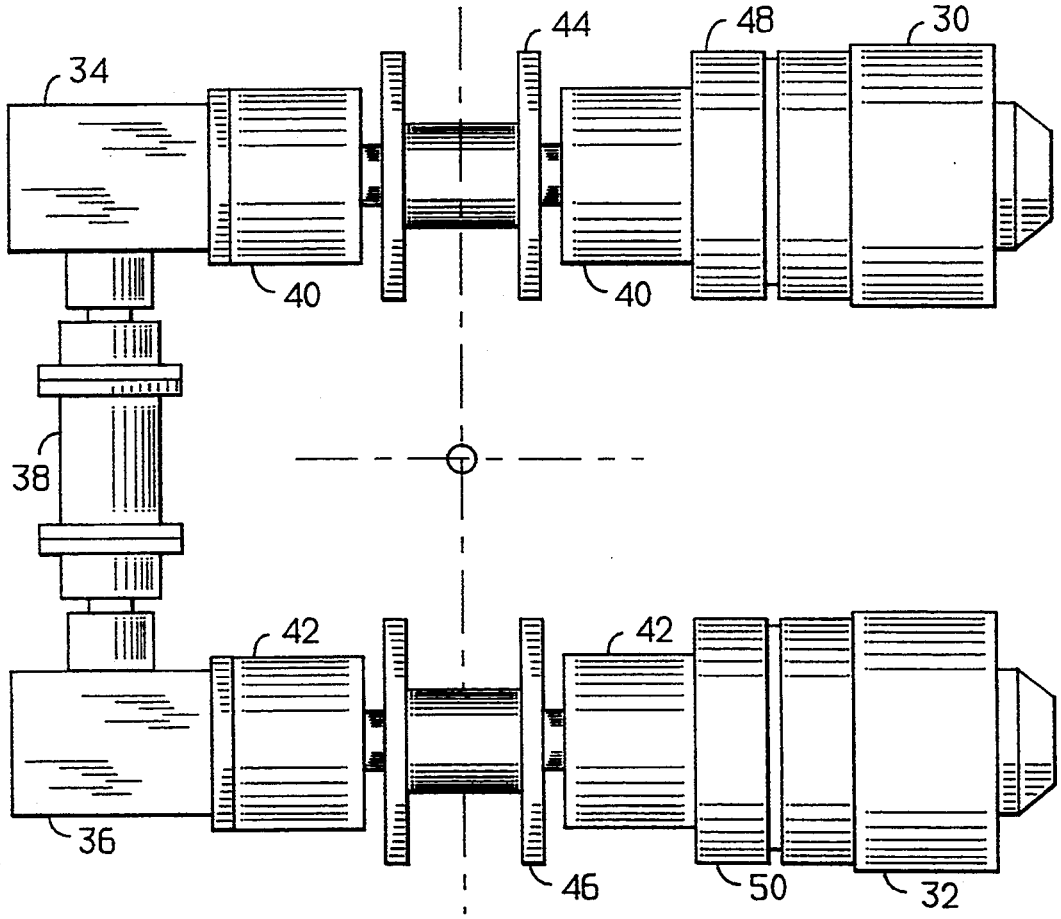
FIG. 6 shows drive motors connected by conical gears via a coupling element.

FIG. 6 shows driver motors 30, 32 connected by conical gears 35, 36, respectively, via a coupling element 38 for synchronous operation. Also shown are respective bearing casings 40, 42, chain or sprocket wheels 44, 46, and gear units 48, 50.

Although the invention has been shown and described with respect to a best-mode embodiment thereof, it should be understood by those skilled in the art that the foregoing and various other changes, omissions and additions in the form and detail thereof may be made therein without departing from the spirit and scope of the invention.

What is claimed is:

1. A device for twisting rope-shaped material, with changing twist direction (SZ), comprising a rotor that rotates about a rotor axis, with two chain drives on opposite sides of the rotor axis, each chain drive forming a corresponding endless closed path, with collet chucks that are attached to the chain drives, that grip the rope-shaped material along a prescribed pathway being part of each endless closed path and that are guided by a corresponding pressure rail, wherein the collet chucks release the rope-shaped material outside of the prescribed pathway being part of each endless closed path and wherein, outside of the prescribed pathway of the corresponding pressure rail, the collet chucks pass through a means for forcing the collet chucks along the corresponding endless closed path, wherein the forced guidance means comprises a profile rail, into which a supporting roller of each collet chuck fits for forced guidance by the profile rail and wherein each collet chuck comprises an outer carriage part and an inner sled part that is movable with respect to the outer carriage part, and wherein the supporting roller is connected to the sled part.

2. A device according to claim 1, wherein the sled part of each collet chuck, including the corresponding supporting roller, is movable outside of the forced guidance means against the rope-shaped material, by means of a pressure roller that is pressure-loaded by the corresponding pressure rail.

3. A device according to claim 2, wherein the pressure rail becomes effective after the supporting roller is released from the profile rail, and before it is reinserted into the profile rail.

4. A device according to claim 2, wherein the corresponding pressure rail has an adjustable position within the device and wherein an adjustment of a pressure force of the pressure roller is achieved by changing the position of the pressure rail.

5. A device according to claim 1, wherein a running rail in parallel with the pressure rail serves to guide the outer carriage part surrounding the sled part, wherein the running rail is longer than the pressure rail and extends in first and second extensions at each end of the running rail beyond corresponding ends of the pressure rail.

6. A device according to claim 5, wherein the first extension is dimensioned in length in a way that the outer carriage part is guided by the running rollers along its length, until the pressure roller becomes effective on the pressure rail.

7. A device according to claim 6, wherein the guidance of the running rail is performed by four running rollers being provided on the outer carriage part, symmetrically arranged with respect to the running rail.

8. A device according to claim 1, wherein the collet chucks are attached to at least two chain links of the chain drives.

9. A device according to claim 8, wherein outside shackles are provided to attach the collet chucks to the chain links of the chain drives.

10. A device according to claim 1, wherein chain drive motors are connected by conical gears or spur-toothed gears, for synchronous operation of the collet chucks attached to the chain drives.

11. A device according to claim 1, wherein the length of the pressure rail with respect to a spacing between the collet chucks attached along the chain drives is such that at least three pairs of collet chucks are simultaneously pressure-loaded by the corresponding pressure rails for acting on the rope-shaped material.

* * * * *